US006065267A

United States Patent [19]

Fisher

[11] Patent Number: 6,065,267

[45] Date of Patent: May 23, 2000

[54] V-SHAPED STACKABLE TRUSS THAT IS SELECTIVELY BRACEABLE

[75] Inventor: Mark E. Fisher, London, United Kingdom

[73] Assignee: Tomcat Global Corporation, Midland, Tex.

[21] Appl. No.: 09/169,080

[22] Filed: Oct. 9, 1998

[51] Int. Cl.[7] ..... E04C 3/02

[52] U.S. Cl. ..... 52/692; 52/690; 52/693; 52/655.1

[58] Field of Search ..... 52/690, 692, 693, 52/650.1, 650.2, 655.1

[56] References Cited

U.S. PATENT DOCUMENTS 3,562,994 2/1971 Von Linsowe ..... 52/655

3,744,206 7/1973 Nelson et al. ..... 52/650

5,205,101 4/1993 Swan et al. .

FOREIGN PATENT DOCUMENTS 859752 11/1956 United Kingdom .

1088460 7/1965 United Kingdom .

1320777 6/1969 United Kingdom .

*Primary Examiner*—Beth A. Stephan

*Assistant Examiner*—Brian E. Glessner

*Attorney, Agent, or Firm*—Jones, Day, Reavis & Pogue

[57] ABSTRACT

A V-shaped stackable truss that is selectively braceable by adding braces to strengthen the truss as needed.

9 Claims, 1 Drawing Sheet

V-SHAPED STACKABLE TRUSS THAT IS SELECTIVELY BRACEABLE

BACKGROUND OF THE INVENTION

1. Field of the Invention

The present invention relates in general to stacking trusses and in particular to a V-shaped stackable truss that can be selectively braced to strengthen the truss.

2. Description of Related Art Including Information Disclosed Under 37 CFR 1.97 and 1.98

In commonly assigned copending patent application Ser. No. 09/169,488, filed of even date herewith, and entitled "Method and Apparatus for Assembling a Lightweight Stackable Truss", which application is incorporated herein by reference in its entirety, there is disclosed a stackable truss in general and in particular a V-shaped stackable truss for use in temporary, demountable construction for exhibition, display, and concert staging.

Also, in commonly assigned copending patent application Ser. No. 09/169,746, filed of even date herewith and entitled "V-Shaped Former For Stacking Truss", which application is incorporated by reference in its entirety, there is disclosed a novel V-shaped former for enabling a V-shaped attachable truss to be connected.

It is well known in the prior art that there is a great need for the construction of exhibition, display, and concert staging that requires the use of truss members that can be connected together in any well-known fashion to form the finished stage or exhibition. Many of these exhibitions or staging displays are quite elaborate and are associated with groups such as music groups that travel from one location to another to perform concerts. This means that the staging must be shipped to the desired location, assembled, the concert performed, the staging disassembled, and shipped again to the next location for the next concert.

Also as is well known, these trusses carry a number of heavy items, such as Kleig lights, loudspeakers, hoists, cables, and the like. Thus, the trusses must be sufficiently strong to hold the equipment required for the particular concert. In some cases, more equipment will be placed on the trusses than at other times. This means that there are times when the trusses must be stronger than at other times depending upon their use.

One way to strengthen the chord, or hollow tube support members forming a part of the trusses, is disclosed in commonly assigned copending application Ser. No. 09/168,725, filed of even date herewith, incorporated herein by reference, and entitled "Method and Apparatus for Strengthening an Elongated Hollow Tube Support Member". In that case, a reinforced elongated hollow support member or chord is formed with a hollow cylindrical tube having spaced, parallel ribs on the interior of each of the hollow tubes extending the length of the hollow tubes for strengthening each hollow tube length.

It would be advantageous to have a V-shaped stackable truss that could be selectively braced to provide a desired strength for a desired use.

SUMMARY OF THE INVENTION

The present invention provides a selectively braceable V-shaped truss.

The V-shaped truss is formed with a plurality of V-shaped formers with each former having an apex and two depending legs forming the "V". Each leg has an outer end. A first elongated chord member is attached to a bracket on the V-shaped former at the apex and second and third elongated chord members are attached to respective brackets at the outer end of each leg. A brace connector is removably connected or removably attached to the first elongated chord member at a point between adjacent apices of a plurality of V-shaped formers. A brace having first and second ends is removably connected between each brace connector and the outer end of each leg of each of the pluralities of the V-shaped formers. As many braces as desired can be used to strengthen the V-shaped truss.

A slot is formed in the first elongated chord member that is attached to apices of adjacent V-shaped formers. The brace connector has a top removeably attached to the first elongated chord members and a bottom connection that enables the braces to be attached between the first chord member and the outer end of one leg and the first chord member and the outer end of the other leg. A first plate extends from the top of the brace connector for removable insertion into the slot of the first elongated chord member that connects the apices of the formers. Second and third spaced plates form the connection extending from the bottom of the brace connector. First and second brace fastening brackets, each on a corresponding outer end of one of the legs of the V-shaped former, allows a brace to be removably attached between each of the second and third spaced plates extending from the bottom of the brace connector and a corresponding brace fastening bracket on the outer end of each leg of adjacent ones of the V-shaped formers. Orifices in the outer ends of the brace and in the spaced plates of the brace connector and in the brace fastening bracket on the outer end of each leg of the formers enable the brace to be removably attached thereto.

Of course, the brace itself may be formed with male connectors on each end for mating with female connectors on the brace connector and the leg brackets or female connectors may be formed on both ends of the brace for connecting with male brackets on the brace connection and on the corresponding outer end of each leg of the V-shaped formers.

Of course, if desired, a male-to-male connection could be utilized by simply placing flat surfaces adjacent each other and inserting a pin in aligned orifices.

The brace connector, for removable attachment to an associated elongated chord member, comprises a bracket having a first side with a shape conforming to at least a portion of the associated the elongated chord member. It also has an opposing second side. A first plate extends outwardly from the first side of the bracket for releasable attachment to the elongated chord member attached to the apex of each of the formers by insertion in a slot therein. Second and third plates extend outwardly from the second side of the bracket to form an angle comparable to the V-angle of the V-shaped former such that braces can be removably attached between each of the second and third plates on the brace connector and the leg bracket on the outer end of a corresponding one of the legs of the V-shaped former.

Thus, it is an object of the present invention to provide a V-shaped stackable truss having a plurality of V-shaped formers holding three elongated chord members in a V-shaped pattern and enabling braces to be selectively connected between the outer ends of the V-shaped legs of the former and the elongated chord member attached to the apex of each of the formers.

It is also an object of the present invention to provide a V-shaped stackable truss that is selectively braceable.

It is still another object of the present invention to provide a brace connector for removable attachment to an elongated chord member connecting a plurality of V-shaped formers at the apex so that a brace can be detachably connected between the brace connector and a bracket at the outer end of each of the legs of the V-shaped formers.

Thus, the present invention relates to a V-shaped stackable truss that is selectively braceable comprising a plurality of V-shaped formers, each former having an apex and two depending legs forming said "V", each leg having an outer end, three elongated chord members, a first bracket on the apex of each V-shaped former for releasably attaching a first elongated chord member to aligned apices of a plurality of V-shaped formers, second and third brackets on the outer ends of the legs of the V-shaped former for releasably attaching one of the second and third elongated chord members to aligned outer ends of corresponding ones of the legs of the plurality of V-shaped formers, a brace connector removably attached to the first elongated chord member at a point between adjacent apices of the plurality of V-shaped formers, and a brace having first and second ends and being removably connected between each brace connector on the outer end of each leg of each of the plurality of V-shaped formers.

The invention also relates to a brace connector for removable attachment to at least one of the elongated chord members that are connected to a plurality of V-shaped formers creating a V-shaped truss, each V-shaped former having an apex and depending legs, each depending leg having an outer end with a bracket thereon to enable the associated elongated chord members to be strengthened with braces connecting the brace connector and the brackets on the outer ends of the depending legs, the brace connector comprising a bracket having a first side with a shape conforming to at least a portion of one of the elongated chord members and an opposing second side, a first plate extending outwardly from the first side of the bracket for releasable attachment to an elongated chord member, and second and third plates extending outwardly from the second side of the bracket and forming an angle comparable to the V-angle of the V-shaped former such that braces can be removably attached between each of the second and third plates and the leg brackets on the outer end of a corresponding one of the legs of the V-shaped former.

BRIEF DESCRIPTION OF THE DRAWINGS

These and other features of the present invention will be more fully disclosed when taken in conjunction with the following Detailed Description of the Preferred Embodiment(s) in which like numerals represent like elements and in which.

DETAILED DESCRIPTION OF THE PREFERRED EMBODIMENT(S)

Figure 1:
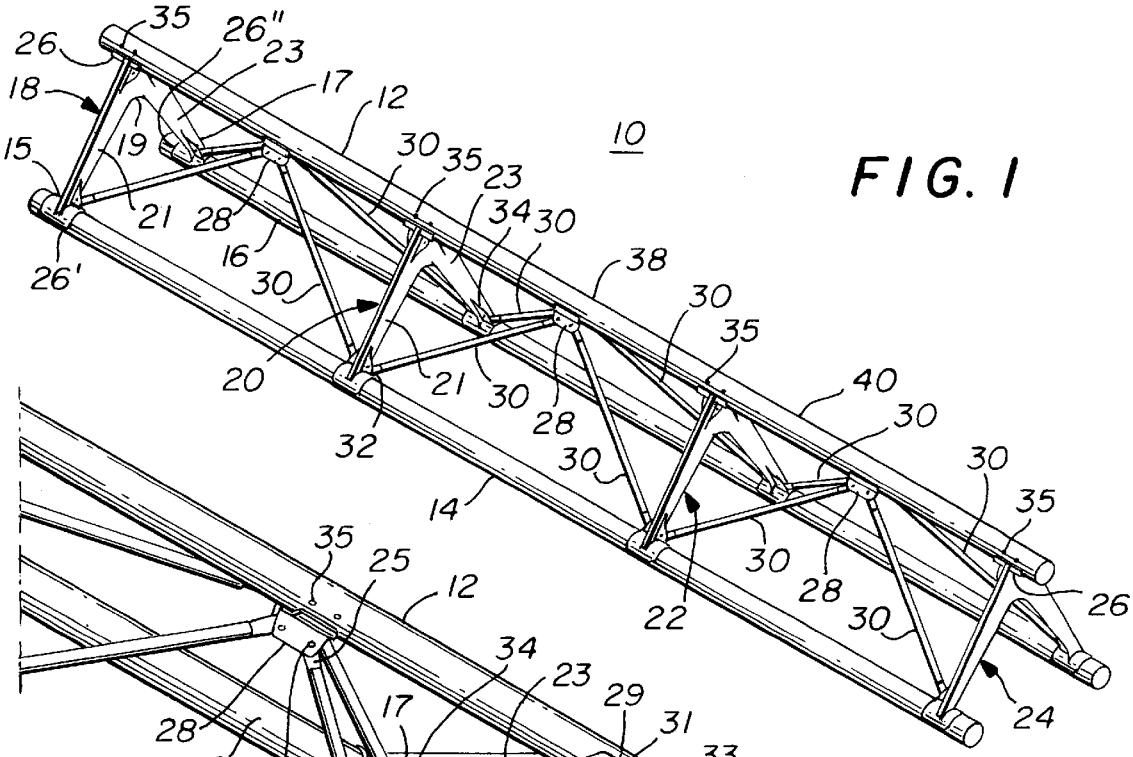
FIG. 1 is a perspective view of a V-shaped truss illustrating the braceable system of the present invention.

FIG. 1 is a perspective view of a V-shaped stackable truss 10 that is constructed so as to be selectively braceable. It has elongated chord members 12, 14, and 16 attached to the apex and the outer ends of opposed legs of each of the formers 18, 20, 22, and 24. Former 18 has an apex 19 to which a bracket 26 is attached, or made an integral part thereof, for attaching the apex of former 18 to the chord 12. The outer ends 15 and 17 of legs 21 and 23 of the V-shaped former 18 have brackets 26 and 27 formed thereon for attachment to the chords 14 and 16. A brace 30 is shown connected between a brace connector 28 and each of the female bracket members 32 and 34 on the outer ends of the legs of each of the formers 18, 20, 22, and 24.

Figure 2:
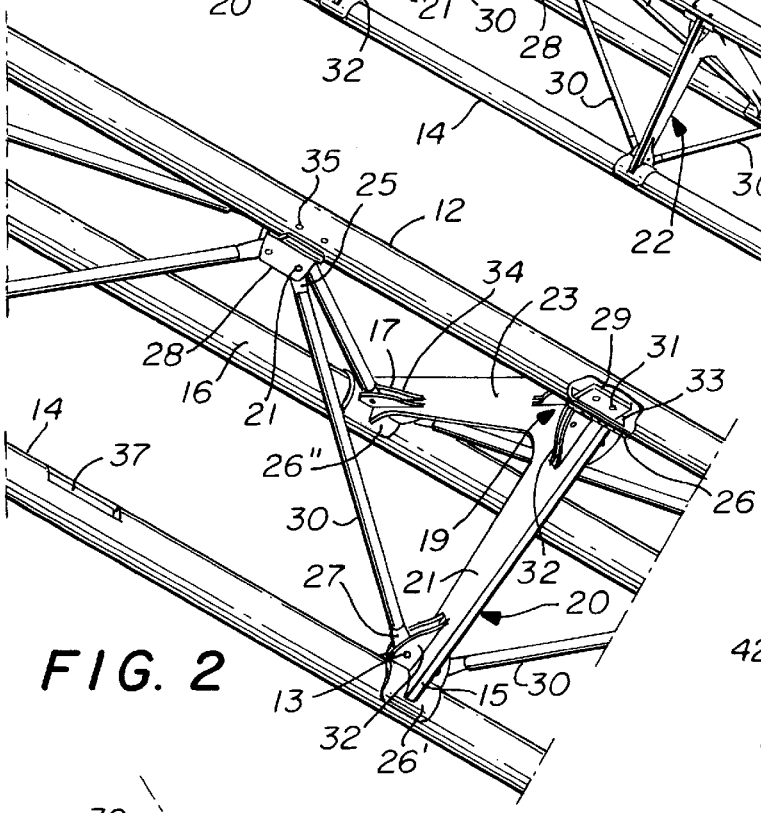
FIG. 2 is an enlarged view of a section of the V-shaped truss illustrating the manner in which the detachable braces are connected between a support chord and the outer ends of the legs of the V-shaped formers.

The bracket 26, 26', 26" at the respective apex of each former is attached to the chord member 12 as will be shown more clearly in FIG. 2 by means of a plate 29 inserted in a slot 33 in the bottom of elongated support chord 12 with pins (such as pin 36 in FIG. 4) inserted through corresponding orifices 31 and 35.

In like manner, the brace connector 28 also has a plate similar to plate 29 on the top side thereof inserted in a slot similar to slot 33 in the bottom of elongated chord 12 and has aligned orifices 31 (similar to that shown in FIG. 2) and 35 for using a pin to removeably attach the brace connector 28 to the elongated chord 12.

While the truss shown in FIG. 1 may be formed a single continuous length of elongated chord members 12, 14, and 16, they may be divided into smaller lengths 12, 38, and 40 as illustrated.

FIG. 2 is a close-up view of one of the V-shaped formers 20, the brace connector 28 and the braces 30 connected between the brace connector 28 and brackets 32, 34 on the outer end of legs 21 and 23 of the V-shaped former 20.

Figure 4:
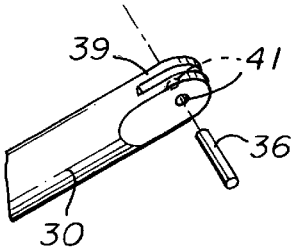
FIG. 4 is a portion of an isometric representation of a brace that has a female connector on the outer end instead of a male connector.

Note, in FIG. 2, that there is a slot 33 in the bottom of elongated support member 12 and a plate 29 on bracket 26 is inserted in the slot 33 and pins, such as pin 36 in FIG. 4, are inserted through aligned orifices 31 in the plate 29 and orifices 35 in the walls of the hollow elongated support member 12 for detachable connection of the chord 12 to the former 20.

In like manner, bracket connector 28 has a vertical plate with orifices therein extending from the top thereof similar to plate 29 and extends in a slot similar to slot 33 in the bottom of elongated support member 12 and pins are placed through aligned orifices 31 and 35 to rigidly and detachably attach the diagonal bracing connector 28 to the elongated support member 12.

It will be noted that the brace 30 has flattened male ends 25 and 27 on each end, one end of which is inserted into a female bracket (46, 48 in FIG. 3) on diagonal bracing connector 28 and the other end inserted in a female connector 32, 34 at the outer end 15, 17 of legs 21, 23 of former 20. Again, a pin, similar to pin 36 in FIG. 4, can be inserted through aligned orifices 13 to rigidly and detachably attach brace 30 to the truss 10.

Figure 3:
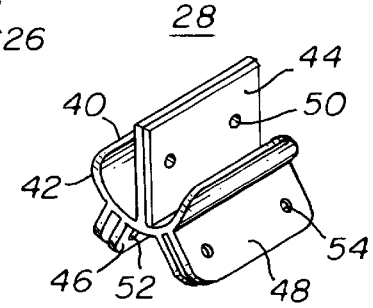
FIG. 3 is an isometric view of the top of a brace connector having an upper portion for connecting to a chord and two lower female plates extending outwardly at an angle to which braces can be detachably connected.

FIG. 3 is a top perspective view of the novel brace connector 28. It will be noted that it has a first side 40 with a shape conforming to at least a portion of one of the elongated chord members 12, 14, and 16 (that, in this example, are tubular) and also has an opposing second side 42. A first plate 44 extends outwardly from the first side 40 of the bracket 28 for releasable attachment to an elongated chord member 12 by means of orifice 50 as illustrated in FIG. 2. Second and third female plates 46 and 48 extend outwardly from the second side 42 of the bracket 28 and form an angle comparable to the V-angle of the V-shaped former 20 shown in FIG. 2 such that braces 30 can be removably attached between each of the second and third plates 46 and 48 by means of orifices 52 and 54 and the corresponding leg brackets 32, 34 on the outer end of a corresponding one of the legs 21, 23 of the V-shaped former 20.

It will be noted in FIG. 3 that the second and third plates 46 and 48 are actually U-shaped or female connectors for receiving a spade or male connector 25, 27 such as that illustrated on brace 30 in FIG. 2.

Figure 6:
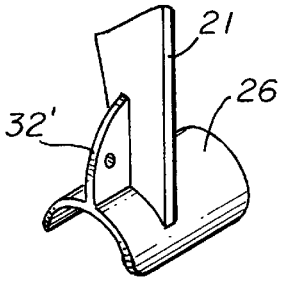
FIG. 6 is a partial perspective view of a partial section of a V-shaped former leg outer end illustrating a male connector thereon to which the brace having a female connector as shown in FIG. 4 can be attached.
Figure 5:
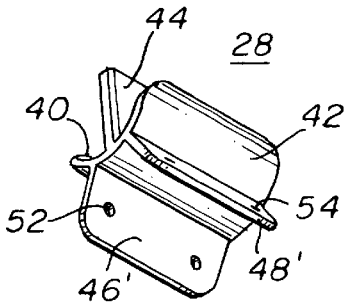
FIG. 5 is a bottom view of a variation of the bracing connector in FIG. 3 illustrating male connecting plates extending downwardly and outwardly from the bottom side thereof.

However, the brace connectors 30 could have a female connector 39 such as shown in FIG. 4. Orifices 41 in the female connector 39 can receive a pin 36 for attaching the brace 30 to a male member 32' such as shown in FIG. 6. In such case, the male member on the brace connector 28 would be as shown in FIG. 5 wherein the brace connector 28 again is as shown in FIG. 3 except that this is a bottom perspective view and in which, on the bottom, the second and third plates 46' and 48' are single and thus are male connectors that could mate with the female connector 39 on the outer end of brace 30 shown in FIG. 4.

At the outer end of the legs 23 and 21 of the former 20, a bracket 32', such as that shown in FIG. 6, can be utilized to accept female connectors, such as connector 39 in FIG. 4. It will be noted in FIG. 6 that the bracket 32' is a male bracket, a single plate or sheet having an orifice therein for receiving the female portion 39 of the brace 30 and for receiving a pin 36 in the aligned orifices.

Thus, in summary, a slot similar to slot 33 or slot 37 shown in FIG. 2 would be formed in the bottom of chord 12 at a point between apices 19 of adjacent V-shaped formers 18, 20, 22, and 24. Brace connector 28 is detachably connected to the chord 12 with a plate 44 extending from the top 40 of the brace connector 28 for removable insertion into the slot such as 33 or 37 in the first elongated chord member 12.

Second and third plates 46 and 48 extend from the bottom of the brace connector 28, and first and second brace fastening brackets 32 and 34, one on each of a corresponding outer end 15 and 17 of legs 21 and 23 of the V-shaped formers, receive one end of the brace 30 in a detachable manner. A male portion on each end 25 and 27 of the brace 30 can be inserted in a female receptacle 32, 34 not only on the brace connector 28 but also on the outer end of each of the legs 21 and 23 of a former 20.

In like manner, the outer ends of the brace 30 may be female ends, such as end 39 shown in FIG. 4, and can be mated with a male bracket, such as 46' and 48' in FIG. 5, on the bracing connector 28 and into a male bracket 32' at the bottom of the former legs 21, 23 as shown in FIG. 6.

Clearly, by using a slot 37 in each of the chord members 14 and 16 (shown only in chord member 14) and brackets 32' at the apex of former 20 (as shown in FIG. 2), braces 30 could be detachably connected from each of the chords 14 and 16 to the apex of each former.

Thus, the novel invention not only allows the truss to be made of any desired length but also to be strengthened by bracing to carry various loads.

The corresponding structures, materials, acts, and equivalents of all means or step plus function elements in the claims below are intended to include any structure, material, or act for performing the function in combination with other claimed elements as specifically claimed.

I claim:

1. A V-shaped stackable truss that is selectively braceable comprising:

a plurality of V-shaped formers, each former having an apex and two depending legs forming said "V";

each leg having an outer end;

three elongated chord members;

first bracket means on each V-shaped former for removably attaching a first elongated chord member to aligned apices of a plurality of V-shaped formers;

second and third bracket means on the V-shaped former for removably attaching one of the second and third elongated chord members to aligned outer ends of corresponding ones of the legs of the plurality of V-shaped formers;

a brace connector removably attached to the first elongated chord member at a point between adjacent apices of the plurality of V-shaped formers; and a brace having first and second ends and being removably attached between each brace connector and the outer end of each leg of each of the plurality of V-shaped formers.

2. The V-shaped stackable truss of claim 1 further comprising:

a slot in the first elongated chord member at a point between apices of adjacent V-shaped formers;

said brace connector having a top and a bottom; said brace connector enabling said braces to be attached between the first chord member and the outer ends of the V-shaped former legs;

a first plate extending from the top of the brace connector for removable attachment to said first elongated chord member by removable insertion into the slot in the first elongated chord member;

second and third plates extending from the bottom of the brace connector;

first and second brace fastening brackets, each on a corresponding one of the outer ends of each leg of the V-shaped formers; and attachment devices for removably attaching a brace between each of the second and third spaced plates of the brace connector and the corresponding brace fastening bracket on the outer end of each leg of adjacent ones of the V-shaped formers.

3. The V-shaped stackable truss of claim 2 further comprising:

a male connector formed on each end of the brace;

first and second female flanges forming the first and second brace fastening brackets on corresponding outer ends of each of the legs of the V-shaped formers;

first and second attachment devices for detachably connecting the male connector on one end of a corresponding one of the braces to a corresponding one of the first and second female flanges;

third and fourth female flanges forming the second and third spaced plates on the brace connector; and third and fourth attachment devices for detachably connecting the male connector on the other end of a corresponding one of the braces to a corresponding one of the third and fourth female flanges in rigid relationship thereby bracing the V-shaped truss.

4. The V-shaped stackable truss of claim 2 further comprising:

a female flange, formed on each end of the brace;

first and second male connectors forming the first and second brace fastening brackets on corresponding outer ends of each of said legs of said V-shaped formers;

first and second attachment devices for detachably connecting the female flange on one end of a corresponding one of the braces to a corresponding one of the first and second male connectors;

third and fourth male connectors forming the second and third spaced plates on the brace connector; and third and fourth attachment devices for detachably connecting the female flange on the other end of a corresponding one of the braces to a corresponding one of the first and second male connectors in rigid relationship thereby bracing the V-shaped truss.

5. The V-shaped stackable truss of claim 1 wherein said brace connector comprises:

a first side with a shape conforming to at least a portion of one of said elongated chord members and an opposing second side;

a first male connector extending outwardly from said first side of said first bracket means;

second and third male connectors extending outwardly from the opposing second side of said first bracket means and forming an angle comparable to the angle of said V-shaped former;

first orifices in said first male connector for attachment of said brace connector to said elongated chord member; and second orifices in said second and third male connectors for attachment of said brace connector to said braces.

6. The V-shaped stackable truss of claim 2 further comprising:

a male connector on each end of said braces;

male connectors forming each of said second and third spaced plates extending from the bottom of said brace connector for connection to one end of said braces; and a male connector forming each of said first and second brace fastening brackets on the outer end of each leg of each V-shaped former to be connected to the other end of said braces.

7. The V-shaped stackable truss of claim 2 further comprising:

a male connector forming both the outer ends of said brace to be detachably connected to the brace connector and to the first and second brace fastening brackets on the outer ends of said legs of said V-shaped former; and a female flange formed on said brace connector and said first and second brackets for mating with corresponding ones of said first male connectors on said brace.

8. The V-shaped stackable truss of claim 2 further comprising:

a female flange forming both outer ends of said brace to be detachably connected to the brace connector and to the first and second brace fastening brackets on the outer ends of said legs of said V-shaped former; and a male connector formed on said brace connector and said first and second brace fastening brackets for mating with corresponding ones of said female flanges on said brace.

9. In a V-shaped stackable truss having a plurality of V-shaped formers each of which has an apex and depending legs, each depending leg having an outer end with a bracket thereon to enable an associated elongated chord member to be strengthened with braces connecting a brace connector and the outer ends of said depending legs, a brace connector comprising:

an elongated bracket having a first side with a shape conforming to at least a portion of one of said elongated chord members and an opposing second side;

a first plate extending axially along and outwardly from said first side of said elongated bracket for releasable attachment to said one of said elongated chord members;

second and third plates extending axially along and outwardly from the second side of said elongated bracket and forming an angle with each other; and orifices in said second and third plates for receiving attachment devices for removably attaching said braces thereto.

* * * * *